US006834686B2

(12) United States Patent
Gray et al.

(10) Patent No.: US 6,834,686 B2
(45) Date of Patent: Dec. 28, 2004

(54) TANK PRESSURE MANAGEMENT SYSTEM

(75) Inventors: John M. Gray, Oakley, OH (US); John P. Nesbit, Loveland, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 43 days.

(21) Appl. No.: 10/238,057

(22) Filed: Sep. 9, 2002

(65) Prior Publication Data

US 2004/0045625 A1 Mar. 11, 2004

(51) Int. Cl.[7] ..... B65B 31/00; B67C 3/00

(52) U.S. Cl. ..... 141/4; 141/45; 141/52; 141/59; 141/82; 141/95; 141/290

(58) Field of Search ..... 141/4–7, 37, 43, 141/45, 50, 52, 53, 59, 82, 94, 95, 285, 290; 62/45.1, 50.1, 54.3; 95/39–41, 288–290; 96/221, 243; 137/587–589

(56) References Cited

U.S. PATENT DOCUMENTS

| | | | | |
|---|---|---|---|---|
| 3,672,180 A | | 6/1972 | Davis | |
| 3,830,074 A | | 8/1974 | Nichols | |
| 3,861,890 A | | 1/1975 | Doncer et al. | |
| 3,884,652 A | | 5/1975 | Nichols | |
| 3,894,942 A | | 7/1975 | Mair | |
| 3,903,708 A | | 9/1975 | Mair | |
| 3,913,633 A | * | 10/1975 | Hiller | 141/45 |
| 3,972,201 A | | 8/1976 | Datis | |
| 4,043,769 A | | 8/1977 | Nishino et al. | |
| 4,110,996 A | | 9/1978 | Thompson | |
| 4,475,928 A | | 10/1984 | Jacobsen | |
| 4,689,064 A | * | 8/1987 | Boulanger et al. | 62/47.1 |
| 5,017,240 A | | 5/1991 | Brown | |
| 5,220,799 A | | 6/1993 | Lievens et al. | |
| 5,255,735 A | | 10/1993 | Raghava et al. | |
| 5,367,882 A | | 11/1994 | Lievens et al. | |
| 5,464,466 A | | 11/1995 | Nanaji et al. | |
| 5,537,911 A | * | 7/1996 | Ohlrogge et al. | 95/22 |
| 5,765,395 A | | 6/1998 | Menzenski | |
| 5,878,792 A | | 3/1999 | Pettazzoni et al. | |
| 5,897,690 A | | 4/1999 | McGrew | |
| 6,174,351 B1 | | 1/2001 | McDowell et al. | |
| 6,286,316 B1 | | 9/2001 | Waldrop et al. | |
| 2002/0069755 A1 | | 6/2002 | Zucchini | |

FOREIGN PATENT DOCUMENTS

| | | |
|---|---|---|
| DE | 24 11 601 A1 | 10/1975 |
| DE | 3720259 A1 | 12/1988 |
| DE | 42 27 416 C1 | 12/1993 |
| FR | 2 553 500 A1 | 10/1983 |
| GB | 1 411 809 | 10/1972 |

(List continued on next page.)

OTHER PUBLICATIONS

D.B. Dow, Petroleum Engineer, Bureau of Mines; *Methods for Recovering Gasoline from Uncondensed Still Vapors*; National Petroleum News (May 31, 1922) pp. 28–31.

(List continued on next page.)

*Primary Examiner*—Timothy L. Maust
(74) *Attorney, Agent, or Firm*—Dinsmore & Shohl LLP

(57) ABSTRACT

A tank pressure management system includes a vapor condensing system in fluid communication with a storage tank and an accumulator vessel in fluid communication with the vapor condensing system and a storage tank. The accumulator vessel includes an air/vapor conduit and a liquid conduit connected to a storage tank. A method of managing air/vapor pressure of a storage tank includes the steps of monitoring the pressure in a storage tank, removing air/vapor from a storage tank, separating liquid from the air/vapor, returning all remaining air/vapor to a storage tank and returning the liquid to a storage tank.

20 Claims, 2 Drawing Sheets

FOREIGN PATENT DOCUMENTS

| | | |
|---|---|---|
| JP | 52-136886 | 11/1977 |
| JP | 52-155181 | 12/1977 |
| JP | 56-9194 | 1/1981 |
| JP | 56-39833 | 4/1981 |
| JP | 56-100603 | 8/1981 |
| JP | 59-5229 | 1/1984 |
| JP | 9-95679 | 4/1997 |
| WO | WO00/25900 | 11/2000 |

OTHER PUBLICATIONS

J. Ekstrõm, Dr. H. Bader, *Condensation Via Indirect Cooling. Recovery of Gasoline Vapors*; Chemie–Technik, 22, Jahrgang (1993), Nr. 10, pp. 42–47. This German reference is believed to be relevant upon a reading of an abstract of the reference written by Derwent World Patent Indexes. The abstract states: Hydrocarbon vapors in gasoline filling stations can be recovered and recirculated as a condensate to the underground storage tanks. The condenser system comprises 3 coolers in series operated with N2 at 0° and N2 at −180° to separate lean gas and recover the condensated gasoline, responsibility. The method prevents hydrocarbon emissions and gasoline losses.

OPW, *OPW Vaporsavor 1, Installation and Trouble Shooting Manual*, Draft of Aug. 19, 2002.

BR 80000565 (Aug. 4, 1981, Brazil). Abstract from Derwent World Patent Indexes stating: The volatile gases leave a storage tank through an air–compensating valve at the tank top, pass through a duct to a water–cooled condenser and then to a valve–controlled tank where uncondensed gases are separated out. The condensed liquid is returned to the storage tank. This system is useful in minimizing the evaporation toss in alc. storage.

* cited by examiner

TANK PRESSURE MANAGEMENT SYSTEM

FIELD OF THE INVENTION

The present invention relates generally to tank pressure management systems, and more particularly to systems and methods for managing pressure in storage tanks.

BACKGROUND OF THE INVENTION

As is known in the art, filling stations allow people to dispense fuel from underground storage tanks through nozzles to a vehicle tank. Absent vapor recovery systems, vapor from the vehicle tank and/or fueling operation typically escapes into the atmosphere as the vapor is displaced by liquid gasoline.

To solve the problem of vapor loss at the nozzle, "Stage II" vapor recovery systems were implemented. More specifically, gasoline dispensing nozzles were provided with vapor recovery systems to lessen the amount of vapor that might escape into the atmosphere when liquid is displaced. One such system is known as the "balance" vapor recovery system and provides a rubber boot which surrounds the dispensing nozzle and extends to form a seal with the fill pipe of the automobile tank. Vapor from the automobile tank is collected and flows through the rubber boot to the storage tank.

Another common Stage II vapor recovery system utilized by dispensing nozzles includes the "vacuum assist" vapor recovery system. Such systems utilize a vacuum pump to collect vapor from the automobile tank through passageways in the nozzle and return the removed vapor to the storage tank.

While the Stage II vapor recovery systems addressed some of the problems found in the art, it was subsequently discovered that such systems can disadvantageously pressurize the storage tanks where more vapor is being returned to the storage tank than gasoline dispensed to the automobile fuel tank. As a result, onboard refueling vapor recovery (ORVR) vehicles were developed to prevent the escape of vapor from the vehicle gasoline tank. It was discovered, however, that Stage II vapor recovery systems, rather than collecting vapor from an ORVR vehicle, would collect fresh air, thus recreating the problem of storage tank pressurization. Therefore, with the onset of the ORVR vehicles, there is now a more urgent need to ensure that the coexistence of the two vapor recovery systems (ORVR and Stage II) do not create greater emissions than before (when only Stage II was present) as a result of overpressure in the storage tanks.

Initially, Stage II vapor recovery systems were adapted to slow or stop Stage II vapor recovery in the presence of an ORVR vehicle. Stage II systems accomplished this by providing various sensors for sensing the presence of an ORVR vehicle and adjusting the recovery of vapor accordingly. While such Stage II sensors were effective in slowing or stopping vapor recovery from an ORVR vehicle, problems still existed when there were no vehicles dispensing fuel as Stage II systems maintain tank pressure through exchange of gasoline and vapor with vehicle gasoline tanks. Thus, without dispensing fuel into vehicles, the natural evaporative behavior of gasoline pressurizes the storage tank (e.g. as a result of higher temperatures or just the natural tendency of hydrocarbon liquids to vaporize). To solve this problem, further systems were developed for managing storage tank pressure.

Most recently, systems utilizing high tech "membrane technology" have been introduced to manage pressure in storage tanks. For example, in U.S. Pat. No. 5,464,466 to Gilbarco, a pump recirculates vapor from a storage tank through a membrane that separates clean air from hydrocarbon vapor, with clean air being exhausted to the atmosphere and hydrocarbon vapor being returned to the tank.

Another system utilizing "membrane technology" includes applicants own system known as the Vaporsaver System. The Vaporsaver System condenses the vapor from the storage tank to yield liquid gasoline and then filters the remaining hydrocarbon vapor through a membrane. Upon separation and membrane filtration, liquid gasoline and saturated vapor are returned to the storage tank and clean air is released into the atmosphere.

The present invention addresses certain issues with systems employing "membrane technology." First, the present invention recognizes that the membranes of the aforementioned systems may fail, potentially leading to the release of dangerous hydrocarbon vapor into the environment. Moreover, with the present invention it is possible to manage tank pressure without releasing any air or vapor into the environment.

Another issue readdressed by the present invention is that the membranes utilized in "membrane technology" eventually wear out and need to be replaced. Replacement of membranes can be expensive, and if not done properly or timely, can result in undesirable emissions. In addition, replacement of membranes requires that the tank pressure management system be shut down during replacement, thus potentially allowing the pressure in the tank to increase. If the pressure in the tank increases beyond that of atmospheric pressure, leaks or releases that the pressure management system seeks to prevent may occur.

Thus, while systems employing membrane technology are certainly helpful for managing pressure in a storage tank, there is still room for enhancing tank pressure management systems with improved properties. Accordingly, there is a desire to manage tank pressure in an efficient, cost effective manner without use of membranes and/or in addition to such membranes.

SUMMARY OF THE INVENTION

Accordingly, the present invention is intended to address and obviate problems and shortcomings and otherwise improve previous tank pressure management systems. More particularly, it is one object of the present invention to provide closed systems and methods for managing pressure in storage tanks.

To achieve the foregoing and other objects in accordance with exemplary embodiments of the present invention, tank pressure management systems comprise a vapor condensing system in fluid communication with a storage tank and an accumulator vessel in fluid communication with the vapor condensing system and a storage tank. In one embodiment, the accumulator vessel includes an air/vapor outlet and a liquid outlet, wherein an air/vapor conduit connects the air/vapor outlet of the accumulator vessel with a storage tank and a liquid conduit connects the liquid outlet of the accumulator vessel with a storage tank. As such, the tank pressure management system of the current invention provides a closed system for condensing liquid gasoline from air/vapor to reduce tank pressure and returning all air, vapor and liquid to a storage tank without a need for emission of air or vapor into the atmosphere.

To still further achieve the foregoing and other objects in accordance with exemplary embodiments of the present invention, a method of managing air/vapor pressure of a storage tank is provided comprising the steps of monitoring the pressure in a storage tank, removing air/vapor from said storage tank when the monitored pressure reaches a first preset level, separating liquid from the air/vapor, returning all remaining air/vapor to a storage tank and returning the separated liquid to a storage tank. Therefore, there is provided a method for condensing liquid gasoline from air/vapor to reduce tank pressure and returning all air, vapor and liquid to a storage tank without emission of air or vapor into the atmosphere.

Still other embodiments, combinations, advantages and objects of the present invention will become apparent to those skilled in the art from the following description wherein there are shown and described alternate exemplary embodiments of this invention for illustration purposes. As will be realized, the invention is capable of other different aspects, objects and embodiments, all without departing from the scope of the invention. Accordingly, the drawings, objects, and descriptions should be regarded as illustrative and exemplary in nature only, and not as restrictive.

DETAILED DESCRIPTION OF EXEMPLARY EMBODIMENTS

Figure 1:
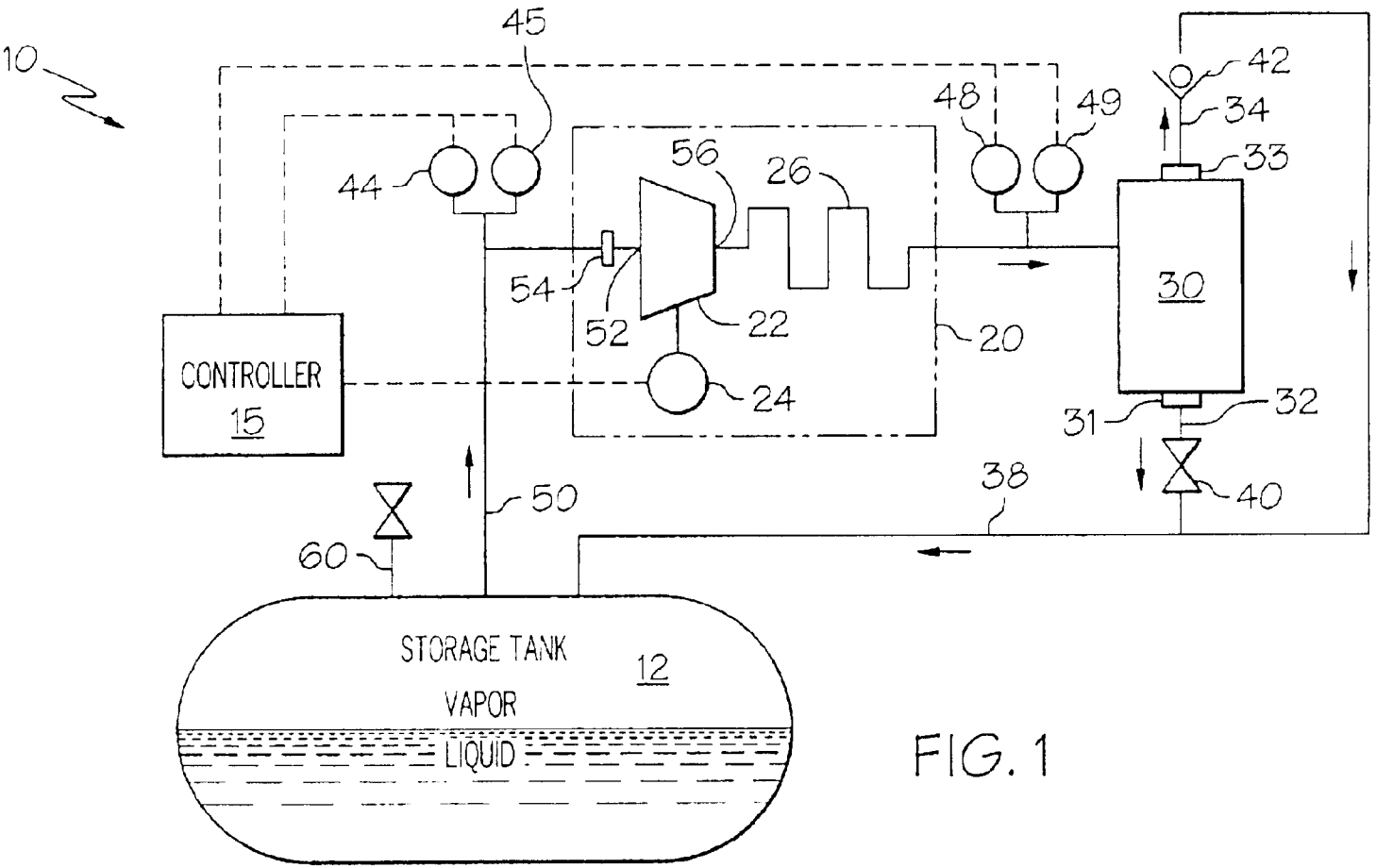
FIG. 1 is a schematic piping and control diagram of exemplary systems in accordance with the present invention.

Referring to the drawing figures in detail, where like numerals indicate the same elements, an exemplary closed system 10 is provided for managing pressure in a storage tank 12. Although other types of materials may be contained such as non-hydrocarbon volatile or non-volatile chemicals or fluids, exemplary tank 12 is adapted to contain hydrocarbons, such as petroleum-based fuel.

In the illustration of FIG. 1, the pressure management system 10 may include a controller 15, a vapor condensing system 20, an accumulator vessel 30, a liquid conduit 32, an air/vapor conduit 34, and a pressure regulator 42. The pressure management system 10 as shown further includes a liquid drain valve 40, on/off pressure switches 44 and 45 and high/low safety shutoff pressure switches 48 and 49, all connected to controller 15.

The vapor condensing system 20 may include a pressure pump 22, also referred to as a "compressor", a motor 24 and a condenser 26. In another embodiment, the vapor condensing system 20 might include any conventional components effective to condense liquid gasoline from air/vapor. As described further below, the pressure pump 22 selectively withdraws air/vapor from storage tank 12 and pushes it through the condensing system. Condensed hydrocarbon liquid (e.g. gasoline) is returned to the tank 12 through a liquid conduit 32 and air/vapor is returned to the tank 12 through an air/vapor conduit 34. As it is contemplated that all of the vapor initially removed from the storage tank 12 is either condensed and/or otherwise returned to the original storage tank (or, alternatively, to a separate storage tank, not shown) by way of return conduits (32, 34 and 38), the tank pressure management system of the present invention is said to be "closed." Thus, air/vapor emissions to the atmosphere are prevented by the systems and methods of the present invention. As will be discussed below, while an emergency vent system can be used with the present systems and methods, it is contemplated that in normal operation, the system will remain substantially closed.

Referring to the flow of the fluid through the pressure management system 10 of the illustrated exemplary embodiment, the controller 15 energizes the motor 24 upon receipt of an "on" signal from the on pressure switch 44. As discussed below, the controller 15 may be implemented by discrete logic on a circuit board for undertaking the sequence of operations. When the controller 15 energizes the motor 24, the pressure pump 22 removes air/vapor from the storage tank 12. In the illustration of FIG. 1, a storage tank suction line 50 establishes a path for fluid communication from the tank 12 to the inlet 52 of the pressure pump 22 as shown. If desired, a tank suction line particulate filter 54 can be disposed in the suction line of the pressure pump 22 to filter particles out of the air/vapor from the storage tank 12 that is evacuated by the pressure pump 22. The storage tank suction line particulate filter 54 may be any type of particulate filter available in the industry.

The pressure pump 22 also generally elevates the temperature of the air/vapor through compression. In one embodiment, the pressure pump 22 may be a rotary vane pump, a diaphragm or any other type of pressure pump, and can be actuated by one single phase AC two horsepower motor 24. The pressure pump 22 discharges the air/vapor through an outlet or discharge port 56. High and low safety shut off pressure switches 48, 49 or similar switches are shown as communicating with the discharge port 56 of the pressure pump 22 for detecting the discharge pressure thereof. The monitored pressure from the discharge port 56 is then communicated to the controller 15.

The pressure pump 22 is illustrated as discharging the air/vapor to a condenser 26. As envisioned herein, the condenser 26 can be implemented by an air cooler/radiator and might be cooled with ambient air. Furthermore, the condenser 26 may have an external fan (not shown) to aid in the condensing/cooling process. In another embodiment, any conventional heat exchanger may be utilized to cool the air/vapor. The condenser 26 may, for example, be provided in the form of an uninsulated segment of the piping line, or by a length of rubber tubing that can be disposed in the piping line.

The condenser 26 condenses the air/vapor from the discharge port 56 of the pressure pump 22. As the temperature of the air/vapor is reduced, liquid gasoline condenses to form an air/vapor/liquid. In this illustrated example, the partially condensed air/vapor/liquid flows from the outlet of the condenser 26 to the inlet of the accumulator vessel 30. The structure of the accumulator vessel 30 may be any structure that provides for accumulation of fluid, including, but not limited to a conventional pipe. The accumulator vessel 30 may be sized larger to support a greater volume of air/vapor mixture and liquid or to facilitate increased cycle times as discussed further below.

The air/vapor/liquid then naturally separates into liquid and air/vapor mixture components in the accumulator vessel 30. In one exemplary embodiment, the inlet of the accumulator vessel 30 is configured to slow the air/vapor/liquid as it enters the accumulator vessel 30 to allow the liquid to "drop out" of the air/vapor/liquid and collect at the bottom of the accumulator vessel 30. In another embodiment, the air/vapor/liquid may be physically separated in the accumulator vessel through the use of steel mesh or other conventional liquid/gas separation arrangements.

The overall pressure inside the accumulator vessel 30 increases proportionally as the volume of air/vapor mixture and liquid within the accumulator vessel 30 increases. Pressure in the accumulator vessel 30 decreases when the air/vapor mixture and liquid is released from the accumulator vessel 30. In the illustrated example of FIG. 1, the accumulator vessel 30 has two outlets, namely an air/vapor outlet 33 and a liquid outlet 31. An air/vapor conduit 34 is connected to the air/vapor outlet 33 and a liquid conduit 32 is connected to the liquid outlet 31. These two conduits (34 and 32) meet to form a single return conduit 38 for return of air/vapor mixture and liquid to the storage tank 12. If desired, however, the air/vapor conduit 34 and the liquid conduit 32 may separately feed back into the storage tank 12. Furthermore, it should be appreciated that the air/vapor conduit 34 and the liquid conduit 32 may be combined to form a single conduit and, thus a single outlet for the air/vapor mixture and the liquid.

In this exemplary embodiment, the air/vapor conduit 34 includes a pressure regulator 42 to control the system operating pressure. When pressure in the accumulator vessel 30 exceeds a predetermined pressure (i.e., 25 p.s.i.), the pressure regulator 42 opens and air/vapor is returned to the storage tank 12 via the air/vapor conduit 34. In another embodiment, the system may be configured so that the controller 15 may send a signal to the liquid drain valve 40 to open when the pressure of the accumulator vessel 30 reaches a predetermined pressure. The pressure of the air/vapor mixture in the accumulator vessel 30 propels the air/vapor mixture toward the storage tank 12 from which the air/vapor originally came. In another embodiment, a vacuum pump may be disposed in the air/vapor conduit 34 to pull the air/vapor toward the storage tank 12. In addition, if desired, a second or secondary vapor recovery system 20 and accumulator vessel 30 might be disposed in the air/vapor conduit 34 to further condense the air/vapor mixture and further separate the air/vapor/liquid. Once the pressure in the accumulator vessel 30 drops below a predetermined pressure, the pressure regulator 42 closes.

A liquid drain valve 40 (illustrated in the exemplary embodiment as a solenoid valve) disposed in the liquid conduit 32 is closed when the pressure pump 22 of the vapor condensing system 20 is in operation. The controller 15 sends a signal to the liquid drain valve 40 to open after the "off" pressure switch 45 generates a signal for the controller 15 to stop the motor 24 of the pressure pump 22 (i.e. when the pressure pump 22 in not in operation). In another embodiment mentioned above, the controller 15 may send a signal to the liquid drain valve 40 to open while the motor 24 of the pressure pump 22 is in operation. In addition, in another embodiment where the liquid drain valve 40 is a pressure actuated valve or float valve, the liquid drain valve 40 may open without first receiving a control signal from the controller 15.

Opening of the liquid drain valve 40 allows the liquid accumulated in the accumulator vessel 30 to drain through the liquid conduit 32 to the storage tank. In one embodiment, the air/vapor remaining in the accumulator vessel 30 when the liquid drain valve 40 opens may also pass through the liquid conduit 32 to tank 12.

In one embodiment, the liquid conduit 32 is positioned with an effective downward slope to facilitate gravity flow of the condensed liquid to the storage tank 12. In another embodiment, the liquid may be pumped to the storage tank 12. Those skilled in the art will appreciate that the air/vapor mixture and the liquid may be returned to more than one storage tank or to a storage tank other than the one from which the air/vapor originally came.

Referring now to the method of operation of the tank pressure management system of the present invention, the pressure of the storage tank 12 is monitored by pressure switches 44, 45. The pressure switches (44 and 45) communicate with the tank 12 for monitoring and generating respective pressure signals. In the exemplary embodiment of FIG. 1, the "on" pressure switch 44 generates a signal when the tank 12 internal pressure is between about 0.1" W.C. and about 0.25" W.C. (i.e., when the tank 12 has a slight internal overpressure). It should be understood that the pressure switch 44 could generate a signal at any desired predetermined tank pressure. The pressure signals are sent to the controller 15, and, in this exemplary embodiment, the controller 15 might be implemented by discrete logic on a circuit board for undertaking the sequence of operations described below. It is understood, however, that the controller 15 can comprise a PC or other computer that is programmed with a software application to undertake the appropriate logic.

When the controller receives pressure signals from the "on" pressure switch 44, the controller outputs signals to actuate the motor 24 of the pressure pump 22 to remove air/vapor from the storage tank 12 to the pressure pump 22.

Liquid gasoline is thereby separated from the air/vapor removed from the storage tank 12. The pressure pump 22 compresses and heats air/vapor from the storage tank 12, and the compressed air/vapor is then propelled to the condenser 26. The condenser 26 cools the air/vapor (e.g. with ambient or chilled air) to form an air/vapor/liquid. The pressure of the air/vapor may be monitored by high and low pressure safety switches 48 and 49 as the air/vapor is propelled to the condenser 26, as discussed above. In one exemplary embodiment such as for a gasoline refueling setup, when the discharge pressure drops below about 15 psig, the low pressure switch 49 generates a low pressure signal, and the signal is sent to the controller 15 to activate an alarm to alert, for example an attendant of conditions and/or to deenergize the pumps of the present invention. In contrast, when the discharge pressure exceeds about 25 psig, the high pressure switch 48 generates a high pressure signal, and the signal is sent to the controller 15 to activate an alarm and/or to deenergize the pumps of the present invention.

The air/vapor/liquid is then moved to an accumulator vessel 30 where the air/vapor/liquid is separated into an air/vapor mixture and a liquid. When the pressure in the accumulator vessel 30 reaches a predetermined value, the pressure regulator 42 opens and allows the air/vapor mixture in the accumulator vessel 30 to return to the storage tank 12 through an air/vapor conduit 34. In another embodiment, when the pressure in the accumulator vessel 30 reaches a predetermined value, the controller might send a signal to the liquid drain valve 40 to open and allow liquid and, if desired, air/vapor mixture to return to the storage tank 12.

In an illustrative example of a gasoline refueling station, when the storage tank 12 internal pressure is between about −0.1" W.C. and about −0.5" W.C. (i.e., when the storage tank 12 has a slight internal vacuum), the "off" pressure switch 45 generates a signal to the controller 15 to deenergize the motor 24 of the pressure pump 22. When the motor 24 is deenergized (e.g. the separating step is ended) a signal is sent from the controller 15 to the liquid drain valve 40 disposed in the liquid conduit 32. When the liquid drain valve 40 receives a signal from the controller that the motor 24 has been deenergized, the liquid drain valve 40 opens and allows the liquid in the accumulator vessel 30 to return to the storage tank 12 through the liquid conduit 32. As previously mentioned, it should be recognized that the air/vapor conduit 34 and the liquid conduit 32 may be combined to form a single conduit and, thus a single outlet for the air/vapor mixture and the liquid. In the illustrated exemplary embodiment, a cycle is completed once the liquid is drained from the accumulator vessel 30.

In another exemplary embodiment, the tank pressure management system would operate in cycles to control vapor expansion in a storage tank. For example, in one embodiment, the system may be designed to periodically run for about ten minutes continuously (i.e. remove air/vapor, condense air/vapor, separate air/vapor/liquid and return air/vapor mixture and liquid). After about ten minutes, the vapor condensing system 20 shuts down for about two minutes, and will start again if tank pressure requires it. This allows the accumulator vessel 30 to drain and return the liquid to a storage tank. As previously mentioned, one method of increasing cycle time (e.g. the amount of time that the system continuously runs) is to increase the size of the accumulator vessel 30. In the event that the pressure in the storage tank reaches dangerous levels, an emergency air vent 60 may be provided in an exemplary embodiment to allow release of pressure. The emergency air vent 60 may be, for example, a solenoid valve or a pressure regulated valve. If desired, the emergency air vent may include a membrane filter to prevent the release of hydrocarbons to the atmosphere in emergency situations. It should be understood, however, that the system 10 does not require the emergency air vent 60 to operate in accordance with the invention.

Figure 2:
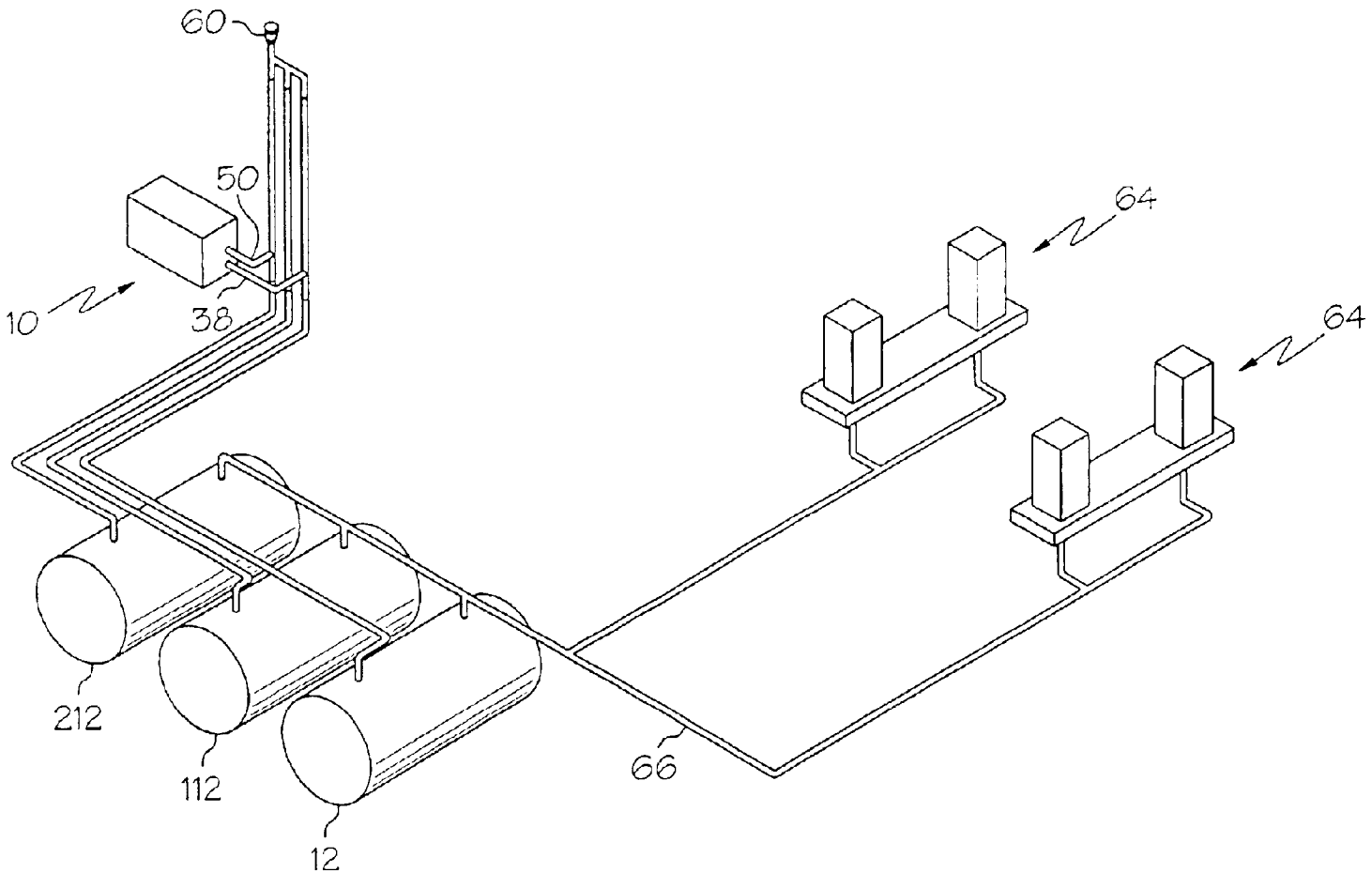
FIG. 2 is a schematic illustration of a system of the present invention as it might be applied in a relatively simple refueling station arrangement.

The tank pressure management system of the present invention may be used alone or in association with other vapor recovery systems and/or tank pressure management systems to manage tank pressure. For example, FIG. 2 illustrates an exemplary arrangement wherein the system 10 is implemented with the aforementioned Stage II vapor recovery system in a simple refueling station application. In another embodiment, the system 10 may be used in association with another tank pressure management system such as, for example, the aforementioned Vaporsaver. In the exemplary embodiment of FIG. 2, the Stage II system channels vapor from the filling station pumps 64 to the storage tanks 12, 112 and 212 through a pump return conduit 66. In the exemplary embodiment, each storage tank (12, 112 and 212) holds a different grade of gasoline. In order to manage tank pressure resulting from return of air/vapor from the Stage II system and natural evaporation of gasoline within the storage tanks (12, 112 and 212), the system 10 removes air/vapor from the storage tanks (12, 112 and 212) through the tank suction line 50 described above. Once the system 10 separates the air/vapor into liquid and an air/vapor mixture, all contents from the separation (liquid and air/vapor mixture) are returned to one storage tank 12. In the exemplary embodiment of FIG. 2, the system manages three tanks (12, 112 and 212) and the separated liquid and air/vapor mixture are returned to the lowest grade storage tank 12. It should be understood, however, that the liquid gasoline and air/vapor mixture may be returned to any tank. Furthermore, if desired, a system 10 may be provided for more than one tank (12, 112 and 212) and, thus may return separated liquid and air/vapor mixture to the storage tank from which it came.

When used in association with other vapor recovery systems or tank pressure management systems (i.e. Stage II or Vaporsaver), it is envisioned that the tank pressure management system of the present invention will be most effective during slow periods of dispensing, or night hours when the gasoline fueling station is closed, and the other vapor recovery systems have no means of controlling storage tank pressure (because they are not active). In such case, the tank pressure management system can condense gasoline at a slightly higher rate than natural gasoline liquid evaporation to reduce tank pressures as needed.

When used alone, it is envisioned that the tank pressure management system 10 of the present invention will be effective throughout the day to manage the pressure in the storage tank. In such case, the components of tank pressure management system may be sized or duplicated according to number and/or size of the storage tank(s) (i.e. the pressure control requirements) that the system is managing.

The foregoing description of the various embodiments of the invention has been presented for the purposes of illustration and description. It is not intended to be exhaustive or to limit the invention to the precise form disclosed. Many alternatives, modifications and variations will be apparent to those skilled in the art of the above teaching. For example, the tank pressure management system in accordance with the present invention may be assembled in a variety of different arrangements and may be operated by a variety of different methods. Accordingly, while some of the alternative embodiments of the tank pressure management system have been discussed specifically, other embodiments will be apparent or relatively easily developed by those of ordinary skill in the art. Accordingly, this invention is intended to embrace all alternatives, modifications and variations that have been discussed herein, and others that fall within the spirit and broad scope of the claims.

What is claimed is:

1. A pressure management system for a storage tanks, comprising:

a vapor condensing system in fluid communication with storage tank configured to selectively remove air/vapor from said storage tank;

an accumulator vessel in fluid communication with said vapor condensing system, said accumulator vessel further comprising an air/vapor outlet and a liquid outlet;

a liquid conduit connecting said liquid outlet and said storage tank;

an air/vapor conduit connecting said air/vapor outlet and said storage tank; and said liquid and air/vapor conduits providing a closed system for returning all air, vapor and liquid from said accumulator vessel to said storage tank.

2. The pressure management system as in claim 1, further comprising a pressure regulator disposed in said air/vapor conduit.

3. The pressure management system as in claim 1, wherein said accumulator vessel is configured to receive partially condensed air/vapor/liquid from said vapor condensing system.

4. A method for managing air/vapor pressure of a storage tank comprising the steps of:

monitoring said pressure in said tank;

when monitored pressure reaches a first preset level, removing air/vapor from said storage tank;

separating liquid from said air/vapor, accumulating said liquid and said air/vapor;

returning all remaining air/vapor to said storage tank; and returning said liquid to said storage tank.

5. The method for managing air/vapor pressure of a storage tank as in claim 4, wherein said separating step includes cooling said air/vapor with an ambient air cooler.

6. The method for managing air/vapor pressure of a storage tank as in claim 4, wherein said liquid is distributed to said storage tank through a first outlet of an accumulator vessel and air/vapor is distributed to said storage tank through a second outlet of an accumulator vessel.

7. The method for managing pressure of a storage tank as in claim 4, wherein said air/vapor and said liquid is returned through an outlet of an accumulator vessel.

8. The method for managing pressure of a storage tank as in claim 4, further comprising the step of terminating air/vapor removal when said monitored pressure drops below a second preset level.

9. The method for managing pressure of a storage tank as in claim 4, further comprising the steps of closing a liquid drain valve when air/vapor is being removed from a storage tank.

10. The method for managing pressure of a storage tank as in claim 9, wherein said liquid is distributed to a storage tank after said separating step is completed.

11. A pressure management system for a storage tank, comprising:

a vapor condensing system in fluid communication with said storage tank;

an accumulator vessel in fluid communication with said vapor condensing system, said accumulator vessel further comprising an air/vapor outlet and a liquid outlet;

a liquid conduit connecting said liquid outlet and said storage tank;

an air/vapor conduit connecting said air/vapor outlet and said storage tank;

a pressure regulator disposed in said air/vapor conduit, wherein said pressure regulator regulates said air/vapor conduit between an open/closed condition; and said liquid and air/vapor conduits providing a closed system for returning all air, vapor and liquid from said accumulator vessel to said storage tank.

12. A pressure management system for a storage tanks, comprising:

a vapor condensing system in fluid communication with said storage tank configured to selectively remove air/vapor from said storage tank;

an accumulator vessel in fluid communication with said vapor condensing system, said accumulator vessel further comprising at least one outlet;

a conduit connecting said outlet and said storage tank; and said conduit providing a closed system for returning all air, vapor and liquid from said accumulator vessel to said storage tank.

13. The pressure management system as in claim 12, wherein said conduit is configured to return air/vapor to a storage tank.

14. The pressure management system as in claim 12, wherein said conduit is configured to return liquid to a storage tank.

15. The pressure management system as in claim 12, wherein said conduit is configured to return air/vapor and liquid to a storage tank.

16. The pressure management system as in claims 1 or 12, wherein said pressure management system is connected to more than one storage tank.

17. A pressure management system for a storage tank, comprising:

a vapor condensing system in fluid communication with said storage tank;

an accumulator vessel in fluid communication with said vapor condensing system, said accumulator vessel further comprising an air/vapor outlet and a liquid outlet;

a liquid conduit connecting said liquid outlet and said storage tank;

a liquid drain valve disposed in said liquid conduit;

an air/vapor conduit connecting said air/vapor outlet and said storage tank; and said liquid and air/vapor conduits providing a closed system for returning all air, vapor and liquid from said accumulator vessel to said storage tank.

18. The pressure management system as in claim 17, wherein said liquid drain valve is configured to open only when said vapor condensing system is not in operation.

19. A pressure management system for a storage tank, comprising:

a pressure monitor for monitoring the air/vapor pressure in said storage tank;

a vapor condensing system in fluid communication with said storage tank;

an accumulator vessel in fluid communication with said vapor condensing system, said accumulator vessel further comprising an air/vapor outlet and a liquid outlet;

a liquid conduit connecting said liquid outlet and said storage tank;

an air/vapor conduit connecting said air/vapor outlet and said storage tank; and said liquid and air/vapor conduits providing a closed system for returning all air, vapor and liquid from said accumulator vessel to said storage tank.

20. A pressure management system for a storage tank, comprising:

a vapor condensing system in fluid communication with said storage tank, wherein said vapor condensing system includes an ambient air cooler;

an accumulator vessel in fluid communication with said vapor condensing system, said accumulator vessel further comprising an air/vapor outlet and a liquid outlet;

a liquid conduit connecting said air/vapor outlet and said storage tank; and said liquid and air/vapor conduits providing a closed system for returning all air, vapor and liquid from said accumulator vessel to said storage tank.

* * * * *

UNITED STATES PATENT AND TRADEMARK OFFICE

CERTIFICATE OF CORRECTION

PATENT NO. : 6,834,686 B2
DATED : December 28, 2004
INVENTOR(S) : Gary, John M. et al.

It is certified that error appears in the above-identified patent and that said Letters Patent is hereby corrected as shown below:

Column 8,
Line 28, change “tanks” to -- tank --.
Line 31, before “storage tank” add -- said --.

Column 9,
Line 33, change “tanks” to -- tank --.

Signed and Sealed this

Nineteenth Day of April, 2005

JON W. DUDAS
*Director of the United States Patent and Trademark Office*